US011352860B2

(12) United States Patent
MacGillivray

(10) Patent No.: US 11,352,860 B2
(45) Date of Patent: Jun. 7, 2022

(54) SHAPED CHARGE WITH RING SHAPED JET

(71) Applicant: Halliburton Energy Services, Inc., Houston, TX (US)

(72) Inventor: Joseph Todd MacGillivray, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 247 days.

(21) Appl. No.: 16/475,592

(22) PCT Filed: Feb. 1, 2018

(86) PCT No.: PCT/US2018/016357

§ 371 (c)(1),
(2) Date: Jul. 2, 2019

(87) PCT Pub. No.: WO2018/160315

PCT Pub. Date: Sep. 7, 2018

(65) Prior Publication Data

US 2021/0131236 A1 May 6, 2021

Related U.S. Application Data

(60) Provisional application No. 62/464,888, filed on Feb. 28, 2017.

(51) Int. Cl.

| | |
|---|---|
| ***E21B 43/117*** | (2006.01) |
| ***F42B 1/028*** | (2006.01) |
| ***E21B 43/116*** | (2006.01) |
| ***F42D 1/02*** | (2006.01) |

(52) U.S. Cl.
CPC ..... *E21B 43/117* (2013.01); *E21B 43/116* (2013.01); *F42B 1/028* (2013.01); *F42D 1/02* (2013.01)

(58) Field of Classification Search
CPC ..... E21B 43/116; E21B 43/117; F42B 1/028
See application file for complete search history.

(56) References Cited

U.S. PATENT DOCUMENTS 2,757,611 A * 8/1956 Church ..... F42B 1/024 102/307
4,466,353 A * 8/1984 Grace ..... F42B 1/02 102/307
5,753,850 A * 5/1998 Chawla ..... F42B 1/02 102/307

(Continued)

FOREIGN PATENT DOCUMENTS

WO 2016022111 A1 2/2016
WO 2018160315 A1 9/2018

*Primary Examiner* — Catherine Loikith
(74) *Attorney, Agent, or Firm* — John Wustenberg; Parker Justiss, P.C.

(57) ABSTRACT

Provided is a shaped charge for use in a wellbore. The shaped charge, in one example, includes a case exterior, the case exterior including an outer surface, and an inner surface forming an cavity, a case interior located within the cavity, a toroidal shaped liner located within the cavity and surrounding a base of the case interior, and explosive material located within a first gap between the inner surface of the case exterior and the toroidal shaped liner and a second gap between the toroidal shaped liner and the case interior.

16 Claims, 5 Drawing Sheets

(56) References Cited

U.S. PATENT DOCUMENTS

| | | | | |
|---|---|---|---|---|
| 7,146,913 | B2 * | 12/2006 | Bell | E21B 29/02 102/322 |
| 7,393,423 | B2 * | 7/2008 | Liu | C06B 33/00 149/108.2 |
| 8,375,859 | B2 * | 2/2013 | Sagebiel | F42B 1/028 102/476 |
| 9,175,936 | B1 | 11/2015 | Collier | |
| 9,175,940 | B1 | 11/2015 | Collier | |
| 2004/0206265 | A1 | 10/2004 | Bell | |
| 2011/0232519 | A1 | 9/2011 | Sagebiel | |
| 2016/0123709 | A1 | 5/2016 | Walker et al. | |

* cited by examiner

SHAPED CHARGE WITH RING SHAPED JET

CROSS-REFERENCE TO RELATED APPLICATION

This application is the National Stage of, and therefore claims the benefit of, International Application No. PCT/US2018/016357 filed on Feb. 1, 2018, entitled "SHAPED CHARGE WITH RING SHAPED JET," which was published in English under International Publication Number WO 2018/160315 on Sep. 7, 2018, and has a priority date of Feb. 28, 2017, based on Provisional Application No. 62/464,888. Both of the above applications are commonly assigned with this National Stage application and are incorporated herein by reference in their entirety.

BACKGROUND

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonating cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired hydraulic openings.

The performance of the well is dependent on the flow area in which the hydrocarbons can be extracted from the surrounding formation. Higher flow areas create more efficient wells that can produce more hydrocarbons. Thus, improvements are needed in the art to create such higher flow areas.

BRIEF DESCRIPTION

Reference is now made to the following descriptions taken in conjunction with the accompanying drawings, in which.

DETAILED DESCRIPTION

Figure 1:
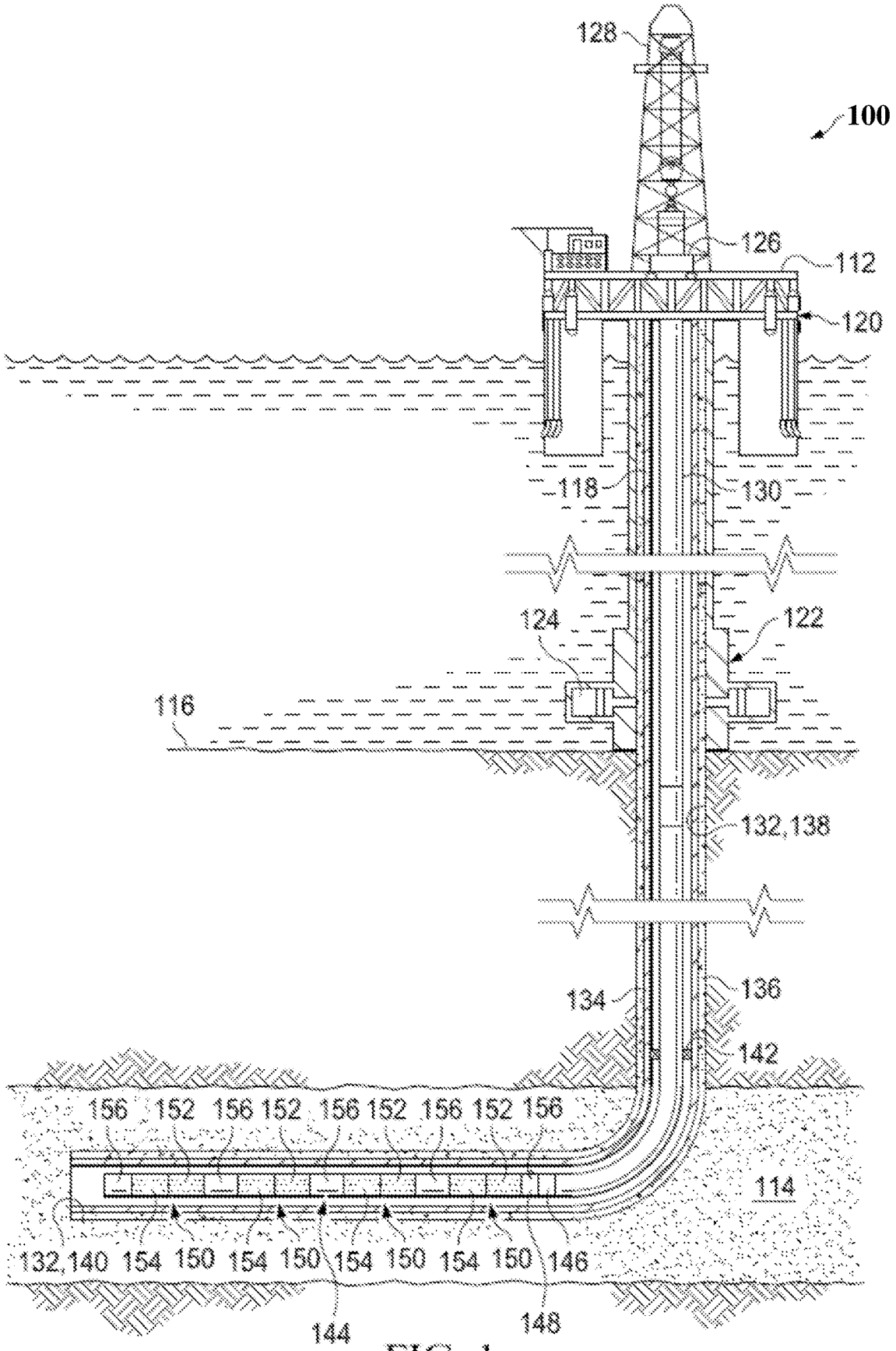
FIG. 1 is a schematic illustration of a well system including are a plurality of perforating gun assemblies of the present disclosure operating in a subterranean formation.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Referring initially to FIG. 1, schematically illustrated is a well system 100 including are a plurality of perforating gun assemblies of the present disclosure operating in a subterranean formation (e.g., from an offshore oil and gas platform). A semi-submersible platform 112 is centered over a submerged oil and gas formation 114 located below sea floor 116. A subsea conduit 118 extends from deck 120 of platform 112 to wellhead installation 122 including subsea blow-out preventers 124. Platform 112 has a hoisting apparatus 126 and a derrick 128 for raising and lowering pipe strings such as work string 130.

A wellbore 132 extends through the various earth strata including formation 114. In the embodiment of FIG. 1, a casing 134 is cemented within wellbore 132 by cement 136. Work string 130 includes various tools such as a plurality of perforating gun assemblies of the present disclosure. When it is desired to perforate formation 114, work string 130 is lowered through casing 134 until the perforating guns are properly positioned relative to formation 114. Thereafter, the shaped charges within the string of perforating guns are sequentially fired, either in an uphole to downhole or a downhole to uphole direction. Upon detonation, the liners of the shaped charges form jets that create a spaced series of perforations extending outwardly through casing 134, cement 136 and into formation 114, thereby allowing fluid communication between formation 114 and wellbore 132. The liners, in accordance with one embodiment of the disclosure, are toroidal shaped liners.

In the illustrated embodiment, wellbore 132 has an initial, generally vertical portion 138 and a lower, generally deviated portion 140 which is illustrated as being horizontal. It should be noted, however, by those skilled in the art that the perforating gun assemblies of the present disclosure are equally well-suited for use in other well configurations including, but not limited to, inclined wells, wells with restrictions, non-deviated wells and the like.

In the embodiment of FIG. 1, work string 130 includes a retrievable packer 142 which may be sealingly engaged with casing 134 in vertical portion 138 of wellbore 132. At the lower end of work string is a gun string, generally designated 144. In the illustrated embodiment, gun string 144 has at its upper or near end a ported nipple 146 below which is a time domain firer 148. Time domain firer 148 is disposed at the upper end of a tandem gun set 150 including first and second guns 152 and 154. In the illustrated embodiment, a plurality of such gun sets 150, each including a first gun 152 and a second gun 154 are utilized. Positioned between each gun set 150 in the embodiment of FIG. 1 is a blank pipe section 156. Blank pipe sections 156 may be used to control and optimize the pressure conditions in wellbore 132 immediately after detonation of the shaped charges. While tandem gun sets 150 have been described with blank pipe sections 156 there between, it should be understood by those skilled in the art that any arrangement of perforating guns may be utilized in conjunction with the present disclosure including both more or less sections of blank pipe as well as no sections of blank pipe, without departing from the principles of the present disclosure.

Figure 2:
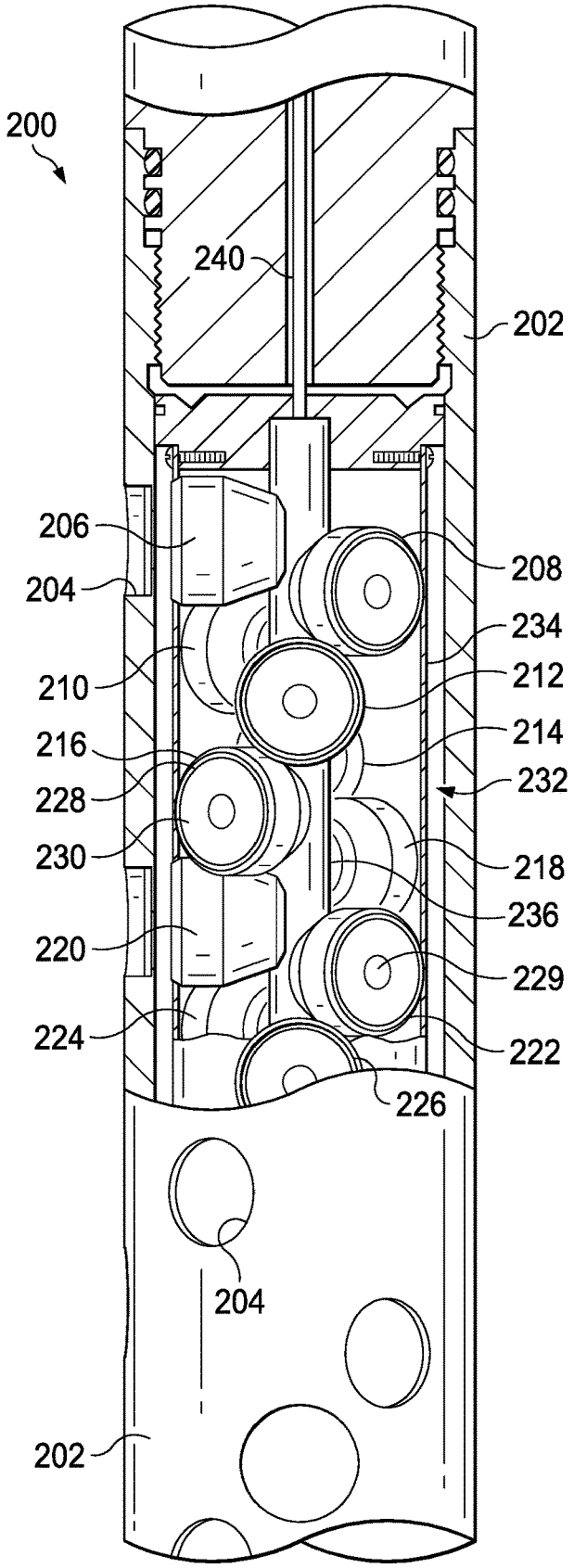
FIG. 2 is a partial cut away view of a perforating gun assembly of the present disclosure.

Referring now to FIG. 2, therein is depicted a perforating gun assembly of the present disclosure that is generally designated 200. In one embodiment, the perforating gun assembly 200 forms at least a portion of the gun sets 150 illustrated in FIG. 1. Perforating gun assembly 200 includes a carrier gun body 202, in one embodiment made of a cylindrical sleeve having a plurality of radially reduced areas depicted as scallops or recesses 204. Radially aligned with each of the recesses 204 is a respective one of a plurality of shaped charges, only eleven of which, shaped charges 206-226, are visible in FIG. 2.

Each of the shaped charges, such as shaped charge 216 includes an outer housing, such as case exterior 228, an inner housing, such as case interior 229 and a liner, such as toroidal shaped liner 230. Furthermore, disposed between each case exterior 228, case interior 229 and toroidal shaped liner 230 is a quantity of explosive material.

The shaped charges 206-226, in the embodiment shown, are retained within carrier gun body 202 by a charge holder 232 which includes an outer charge holder sleeve 234 and an inner charge holder sleeve 236. In this configuration, outer tube 234 supports the discharge ends of the shaped charges, while inner tube 236 supports the initiation ends of the shaped charges. Disposed within inner tube 236 is a detonator cord 240, such as a Primacord, which is used to detonate the shaped charges. In the illustrated embodiment, the initiation ends of the shaped charges extend across the central longitudinal axis of perforating gun assembly 200 allowing detonator cord 240 to connect to the high explosive within the shaped charges through an aperture defined at the apex of the housings of the shaped charges.

In the embodiment of FIG. 2, each of the shaped charges 206-226 is longitudinally and radially aligned with one of the recesses 204 in carrier gun body 202 when perforating gun assembly 200 is fully assembled. In the illustrated embodiment, the shaped charges are arranged in a spiral pattern such that each of the shaped charge is disposed on its own level or height and is to be individually detonated so that only one shaped charge is fired at a time. It should be understood by those skilled in the art, however, that alternate arrangements of shaped charges may be used, including cluster type designs wherein more than one shaped charge is at the same level and is detonated at the same time, without departing from the principles of the present disclosure.

Figure 3:
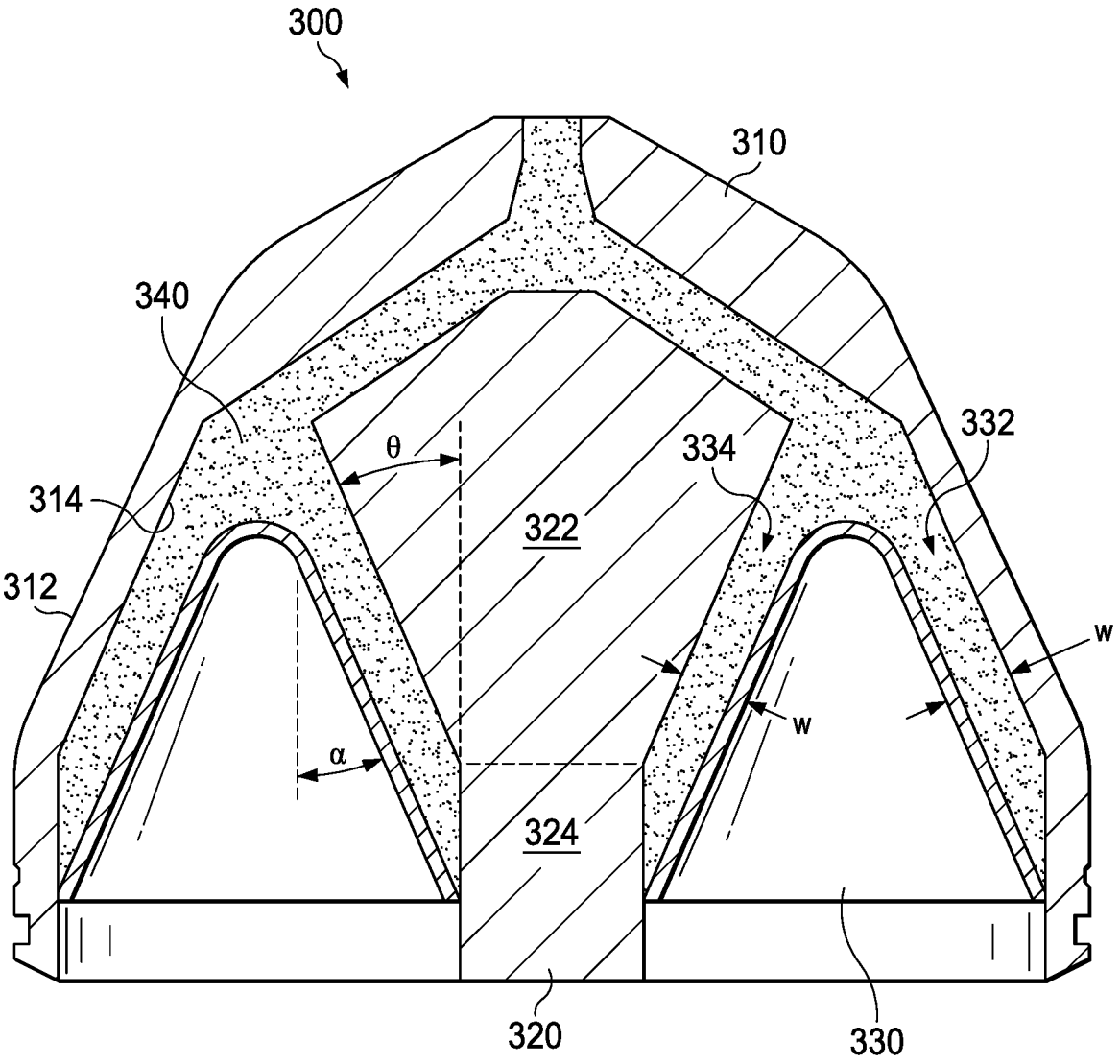
FIG. 3 is an alternative embodiment of a shaped charge in accordance with the disclosure.

Referring now to FIG. 3, therein is depicted is a cross-sectional view of an alternative embodiment of a shaped charge 300 in accordance with the disclosure. The shaped charge 300 illustrated in FIG. 3, in one embodiment, is similar to one or more of the shaped charges 206-226 illustrated in FIG. 2. As is illustrated in the embodiment of FIG. 3, the shaped charge 300 includes a case exterior 310. The case exterior 310, in the embodiment shown, includes an outer surface 312 and an inner surface 314 forming a cavity. In one embodiment, the case exterior 310 is a single pieces case exterior that forms the entire cavity.

The shaped charge 300 of FIG. 3, further includes a case interior 320 located within the cavity (e.g., the cavity formed by the inner surface 314). The case interior 320 may comprise a stand-alone piece positioned within the cavity formed by the inner surface 314. In an alternative embodiment, the case exterior 310 and case interior 320 might form a single material piece, such as might be formed by investment casting or other conventional processes.

The case interior 320, in accordance with one embodiment of the disclosure, includes a first larger inner portion 322 and a second smaller outer portion 324. In the embodiment of FIG. 3, however, the first larger inner portion 322 has a shape (e.g., cross-sectional shape) of a polygon. In fact, the first inner portion 322 might be shaped as a pentagon or hexagon, among other polygons, and remain within the purview of the disclosure. Notwithstanding, the case interior 320 may take on a variety of different shapes and/or sizes and remain within the purview of the disclosure, including a case interior 320 comprising a single diameter, among others, as well as a case interior 320 having a circular, curved or oval shape (e.g., cross-sectional shape), among others.

In the embodiment of FIG. 3, the first larger inner portion 322 is shaped as a hexagon, and more particularly an irregular hexagon. In the disclosed embodiment, a downward slanting side of the first inner portion 322 has an angle ($\theta$). The angle ($\theta$) may vary according to different aspects of the disclosure, but in one embodiment ranges from about 15 degrees to about 45 degrees. Other embodiments exist wherein the angle ($\theta$) is more or less than this disclosed range.

The shaped charge 300 illustrated in the embodiment of FIG. 3 further includes a toroidal shaped liner 330. In the embodiment of FIG. 3, the toroidal shaped liner 330 is located within the cavity formed by the inner surface 314 and is surrounding a base of the case interior 320. Further to this embodiment, the toroidal shaped liner 330 extends up past the second smaller outer portion 324 and only up a portion of the first larger inner portion 322. Accordingly, in certain embodiments, the case interior 320 extends into the cavity substantially more (e.g., 20 percent or more) than the toroidal shaped liner 330.

Further to the embodiment of FIG. 3, the toroidal shaped liner 330 is positioned within the cavity so as to create a first gap 332 between the inner surface 314 of the case exterior 310 and the toroidal shaped liner 330, and a second gap 334 between the toroidal shaped liner 330 and the case interior 320. In one particularly advantageous embodiment, the first gap 332 and the second gap 334 have substantially similar cross-sectional widths (w).

Figure 4B:
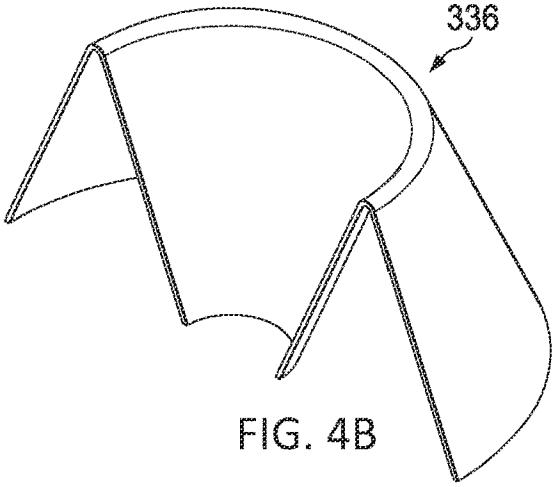
FIGS. 4A through 4D illustrate the liner taking the shape of the cross-section of a traditional conical or hemispherical liner.
Figure 4D:
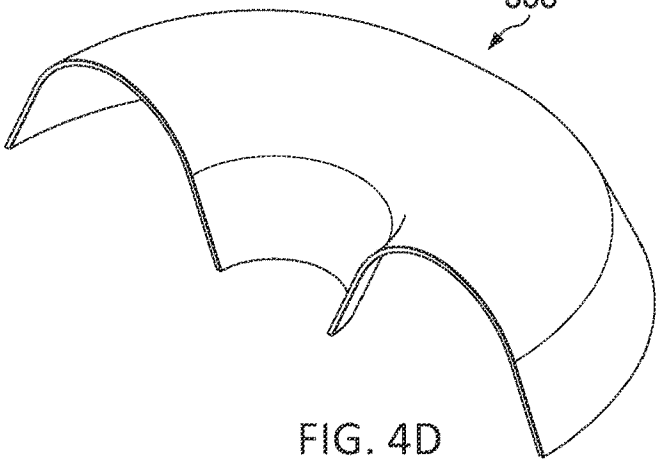
Figure 4A:
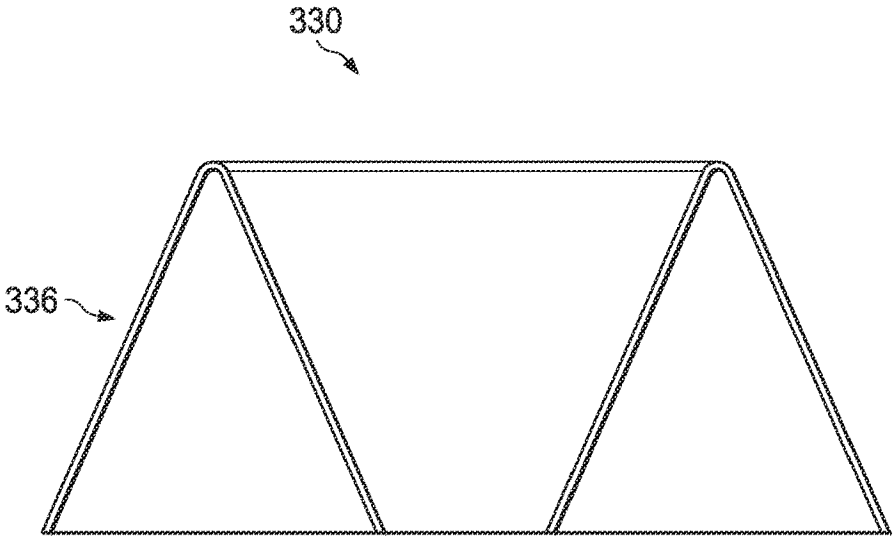
Figure 4C:
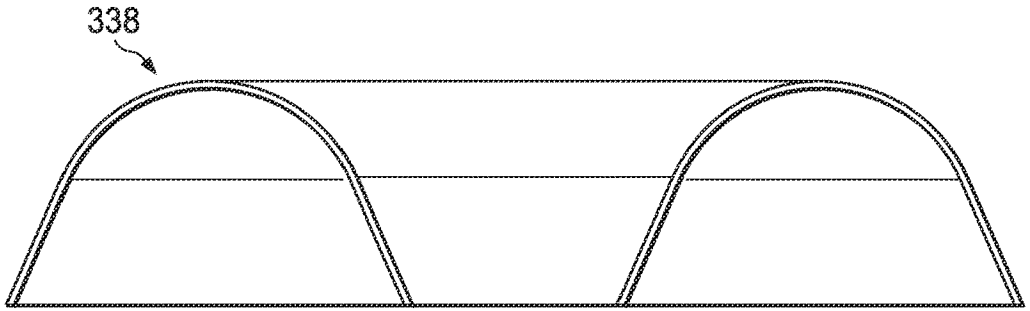

The toroidal shaped liner 330 may take upon a variety of different shapes and/or sizes and remain within the scope of the disclosure. Turning briefly to FIGS. 4A and 4B, illustrated is one embodiment wherein the toroidal shaped liner 330 is shaped as a conical toroidal shaped liner 336. A conical toroidal shaped liner 336, in accordance with the disclosure, includes both traditional conical designs as well as modified conical designs (e.g., including a trumpet type design.) FIGS. 4C and 4D illustrate a further embodiment wherein the toroidal shaped liner 330 is shaped as a hemispherical toroidal shaped liner 338. Other toroidal shaped liners 330 are within the purview of the disclosure.

Returning to FIG. 3, the toroidal shaped liner 330 takes the general shape of a conical toroidal shaped liner. In the disclosed embodiment, a downward slanting side of the toroidal shaped liner 330 has an angle ($\alpha$). The angle ($\alpha$) may vary according to different aspects of the disclosure, but in one embodiment ranges from about 15 degrees to about 45 degrees. Other embodiments exist wherein the angle ($\alpha$) is more or less than this disclosed range. In accordance with one embodiment of the disclosure, the angle ($\theta$) of the downward slanting side of the first larger inner portion 322 substantially mirrors the angle ($\alpha$) of the downward slanting side of the toroidal shaped liner 330.

The shaped charge 300 illustrated in FIG. 3 further includes explosive material 340 located in the cavity. In the embodiment of FIG. 3, the explosive material 340 is located within the first gap 332 and the second gap 334. The explosive material 340, in the embodiment of FIG. 3, is additionally located within a booster channel surrounding a top side of the first larger inner portion 322.

In the embodiment of FIG. 3, the shaped charge 300 includes but four pieces: case exterior 310, case interior 320 (e.g., whether a single or multi-piece design), toroidal shaped liner 330 and explosive material 340. In this embodiment, the case exterior 310 is used to house the explosive material 340, toroidal shaped liner 330, and case interior 320. The case interior 320, in the embodiment of FIG. 3, is used to shape the wave of the detonation near an apex of the charge, so that the detonation wave traverses the toroidal shaped liner 330 in a ring shape. The case interior 320 is also used to shape the explosive material 340 near the toroidal shaped liner 330.

A shaped charge, such as the shaped charge 300 of FIG. 3, may be manufactured a variety of different ways—without limitation to any specific method. In one embodiment, a case exterior could be provided, the case exterior forming a cavity. In this embodiment, explosive material could then be placed within the cavity, followed by the case interior being pressed within the explosive material within the cavity. Following the placement of the case interior within the cavity, the toroidal shaped liner could be pressed within the explosive material, the toroidal shaped liner ultimately being located within the cavity and surrounding a base of the case interior.

In an alternative embodiment, a shaped charge, such as the shaped charge 300 of FIG. 3, may be manufactured by providing a case exterior already having the case interior placed within the cavity thereof. In one embodiment, the case exterior and case interior are of a single fixed piece design at this stage of manufacture. Thereafter, the explosive material might be placed within the cavity and surrounding the case interior. The toroidal shaped liner could then be pressed within the explosive material, the toroidal shaped liner ultimately being located within the cavity and surrounding a base of the case interior.

Figure 5:
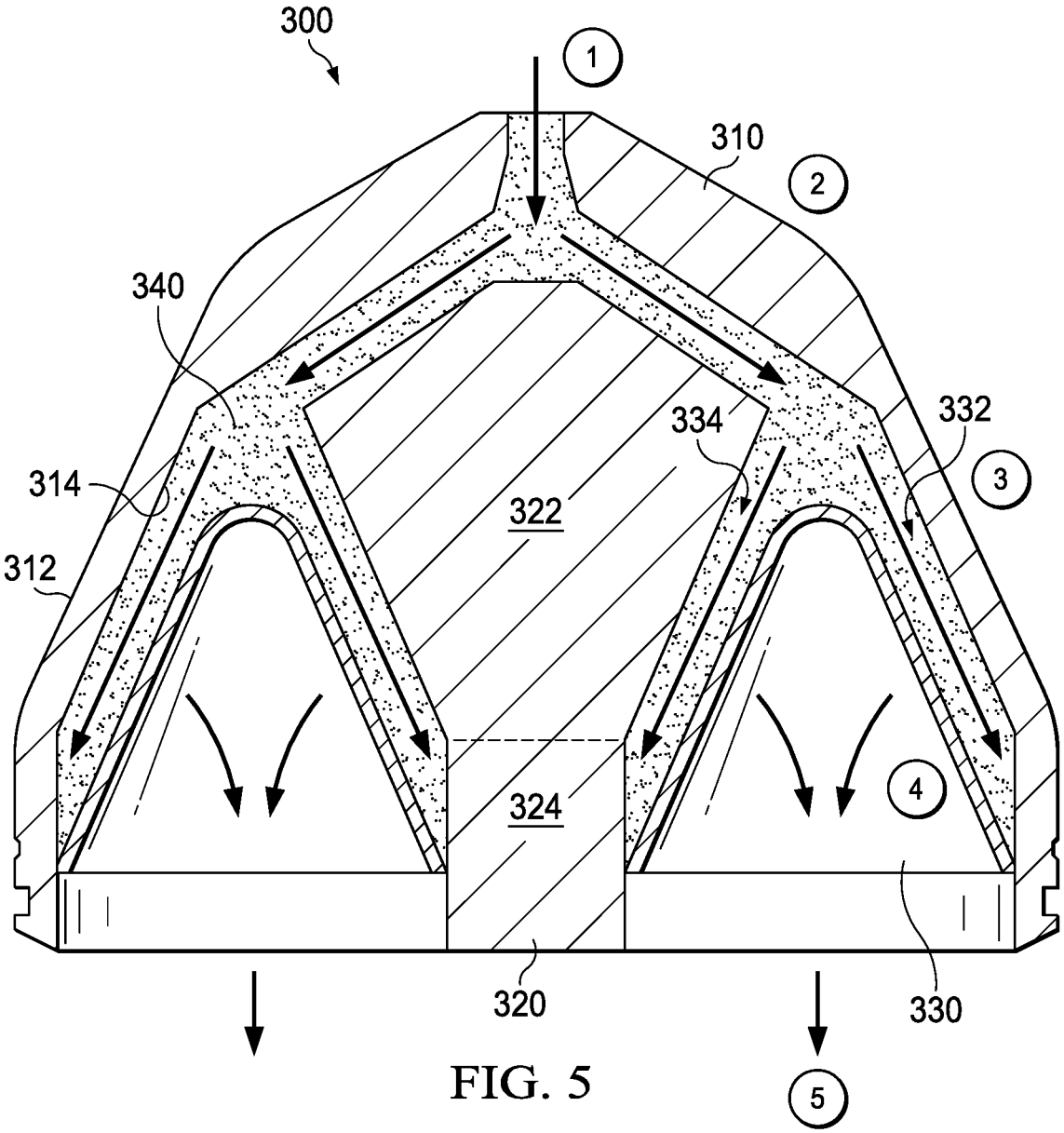
FIG. 5 illustrates one method by which a shaped charge in accordance with the disclosure might fire.

Turning to FIG. 5, illustrated is one method by which a shaped charge, such as the shaped charge 300 of FIG. 3, might fire. At stage 1, the shaped charge 300 is detonated and the detonation wave begins to travel down the booster channel. The detonation wave then travels down the interior section of the case during stage 2. During this stage, the detonation wave starts to take the form of an expanding ring. Once the detonation reaches point 3, it begins to traverse down the edges of the toroidal shaped liner 330 causing it to collapse. As the toroidal shaped liner 330 collapses (stage 4) it begins to form a ringed shape jet. As the jet expands, it forms a jet the shape of a cylinder (stage 5).

Traditional conical and hemispherical shaped charges used in oil and gas wells create a solid rod-shaped jet. The proposed shaped charge, such as the shaped charge 300, is configured to create a hollow, cylindrical shaped jet that would be capable of producing larger holes. In contrast to other concepts, which might use an outer shell to house the mainload explosive and liner, and a separate shell to house the primer explosives, the present disclosure may use a single outer shell (e.g., the case exterior) to house the explosive and the toroidal shaped liner, and use the case interior (e.g., an inert material) to shape the detonation wave. Accordingly, no primer explosive is required to form the cylindrical shaped jet.

While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

What is claimed is:

1. A shaped charge for use in a wellbore, comprising:
   - a case exterior, the case exterior including an outer surface, and an inner surface forming a cavity;
   - a case interior located within the cavity, the case interior having a first larger inner portion and a second smaller outer portion, the first larger inner portion having a cross-sectional shape of a pentagon or hexagon;
   - a toroidal shaped liner located within the cavity and surrounding a base of the case interior; and
   - explosive material located within a first gap between the inner surface of the case exterior and the toroidal shaped liner and a second gap between the toroidal shaped liner and the case interior.

2. The shaped charge of claim 1, wherein the case exterior is a single piece case exterior.

3. The shaped charge of claim 1, wherein the first larger inner portion has a cross-sectional shape of an irregular pentagon or irregular hexagon.

4. The shaped charge of claim 1, wherein an angle ($\theta$) of a downward slanting side of the first larger inner portion substantially mirrors an angle ($\alpha$) of a downward slanting side of the toroidal shaped liner.

5. The shaped charge of claim 1, wherein the first gap and the second gap have substantially similar cross-sectional widths (w).

6. The shaped charge of claim 1, wherein the toroidal shaped liner is a conical toroidal shaped liner or a hemispherical toroidal shaped liner.

7. A perforating gun assembly for use in a wellbore, the perforating gun assembly comprising:

a carrier gun body;

a charge holder disposed within the carrier gun body; and a plurality of shaped charges supported within the carrier gun body by the charge holder, wherein each shaped charge includes:

a case exterior, the case exterior including an outer surface, and an inner surface forming a cavity;

a case interior located within the cavity, the case interior having a first larger inner portion and a second smaller outer portion, the first larger inner portion having a cross-sectional shape of a pentagon or hexagon;

a toroidal shaped liner located within the cavity and surrounding a base of the case interior; and explosive material located within a first gap between the inner surface of the case exterior and the toroidal shaped liner and a second gap between the toroidal shaped liner and the case interior.

8. The perforating gun assembly of claim 7, wherein the case exterior is a single piece case exterior.

9. The perforating gun assembly of claim 7, wherein the first larger inner portion has a cross-sectional shape of an irregular pentagon or irregular hexagon.

10. The perforating gun assembly of claim 7, wherein an angle ($\theta$) of a downward slanting side of the first larger inner portion substantially mirrors an angle ($\alpha$) of a downward slanting side of the toroidal shaped liner.

11. The perforating gun assembly of claim 7, wherein the first gap and the second gap have substantially similar cross-sectional widths (w).

12. The perforating gun assembly of claim 7, wherein the toroidal shaped liner is a conical toroidal shaped liner or a hemispherical toroidal shaped liner.

13. A method for perforating a wellbore, comprising:

positioning a perforating gun assembly at a desired location within a wellbore, the perforating gun assembly including:

a carrier gun body;

a charge holder disposed within the carrier gun body; and a plurality of shaped charges supported within the carrier gun body by the charge holder, wherein each shaped charge includes:

a case exterior, the case exterior including an outer surface, and an inner surface forming a cavity;

a case interior located within the cavity, the case interior having a first larger inner portion and a second smaller outer portion, the first larger inner portion having a cross-sectional shape of a pentagon or hexagon;

a toroidal shaped liner located within the cavity and surrounding a base of the case interior; and explosive material located within a first gap between the inner surface of the case exterior and the toroidal shaped liner and a second gap between the toroidal shaped liner and the case interior; and detonating the explosive material within the plurality of shaped charges to form a plurality of ring shaped jets that penetrate the wellbore and form a plurality of openings therein.

14. The method of claim 13, wherein the case exterior is a single piece case exterior.

15. The method of claim 13, wherein the first larger inner portion has a cross-sectional shape of an irregular pentagon or irregular hexagon.

16. The method of claim 13, wherein the toroidal shaped liner is a conical toroidal shaped liner or a hemispherical toroidal shaped liner.

* * * * *